US011503905B2

(12) United States Patent
Matthai et al.

(10) Patent No.: US 11,503,905 B2
(45) Date of Patent: Nov. 22, 2022

(54) WORKSTATION ASSEMBLY

(71) Applicant: HERMAN MILLER, INC., Zeeland, MI (US)

(72) Inventors: John Thomas Matthai, Holland, MI (US); Peter James Keyzer, Caledonia, MI (US)

(73) Assignee: MILLERKNOLL, INC., Zeeland, MI (US)

( * ) Notice: Subject to any disclaimer, the term of this patent is extended or adjusted under 35 U.S.C. 154(b) by 0 days.

(21) Appl. No.: 17/224,817

(22) Filed: Apr. 7, 2021

(65) Prior Publication Data

US 2021/0315378 A1 Oct. 14, 2021

Related U.S. Application Data

(60) Provisional application No. 63/007,763, filed on Apr. 9, 2020.

(51) Int. Cl.
*A47B 21/06* (2006.01)
*A47B 9/20* (2006.01)

(52) U.S. Cl.
CPC ..... *A47B 21/06* (2013.01); *A47B 9/20* (2013.01); *A47B 2021/066* (2013.01)

(58) Field of Classification Search
CPC ..... A47B 21/06; A47B 2021/066
USPC ..... 108/50.02; 312/223.6
See application file for complete search history.

(56) References Cited

U.S. PATENT DOCUMENTS 3,559,352 A 2/1971 Magnuson
4,248,477 A 2/1981 Netters
4,600,173 A * 7/1986 Frascaroli ..... F16B 7/044 248/228.6
4,604,955 A 8/1986 Fleischer et al.
4,604,956 A 8/1986 Grebel et al.
4,646,655 A 3/1987 Robolin
4,762,072 A * 8/1988 Boundy ..... A47B 21/06 108/50.02
4,838,175 A * 6/1989 Hauville ..... B01L 9/02 108/50.02

(Continued)

FOREIGN PATENT DOCUMENTS

DE 102017109188 A1 10/2018
DE 102020127202 A1 * 4/2021 ..... A47B 21/02

OTHER PUBLICATIONS

International Search Report with Written Opinion for related Application No. PCT/US2021/026219 dated Jul. 9, 2021 (16 Pages).

(Continued)

*Primary Examiner* — Jose V Chen

(74) *Attorney, Agent, or Firm* — Michael Best & Friedrich LLP

(57) ABSTRACT

A workstation assembly includes a base having an interior. A height adjustable support column is moveable relative to the base. A work surface is coupled to the support column. A cable track has a first end connected to the base and a second end connected to and moveable with the support column. A power access point can be connected to the work surface and accessible to a user. A motor is connected to the support column to adjust the height relative to the base. A power splitter is connected to the base and configured to receive an AC power input and branch the AC power to a primary path and a secondary path.

20 Claims, 10 Drawing Sheets

(56) References Cited

U.S. PATENT DOCUMENTS 4,852,500 A * 8/1989 Ryburg ..... A47B 21/06 108/50.01
4,879,955 A * 11/1989 Moll ..... A47B 21/06 108/50.02
4,941,412 A * 7/1990 Engel ..... A47B 21/06 108/106
5,083,838 A 1/1992 Maxwell, Jr.
5,220,871 A * 6/1993 Grund ..... A47B 17/033 312/196
5,237,935 A * 8/1993 Newhouse ..... A47B 83/001 108/50.02
5,357,874 A * 10/1994 Palmer ..... A47B 21/06 108/50.02
5,394,809 A * 3/1995 Feldpausch ..... A47B 9/14 108/147.21
5,606,920 A * 3/1997 Meyer ..... A47B 87/002 108/50.02
5,831,211 A * 11/1998 Gartung ..... A47B 21/06 52/220.7
5,901,513 A * 5/1999 Mollenkopf ..... A47B 21/06 312/196
6,029,587 A * 2/2000 Rozier, Jr. ..... A47B 9/14 108/50.02
6,082,840 A * 7/2000 Chau ..... A47B 21/06 108/50.02
6,086,028 A * 7/2000 Pfister ..... A47B 21/06 108/50.01
6,145,448 A 11/2000 Marschand et al.
6,182,579 B1 2/2001 Chang
6,202,567 B1 * 3/2001 Funk ..... A47B 21/06 108/50.01
6,286,441 B1 9/2001 Burdi et al.
6,293,506 B1 * 9/2001 Gutgsell ..... A47B 21/06 108/50.01
6,327,983 B1 * 12/2001 Cronk ..... A47B 21/06 108/50.02
6,352,037 B1 * 3/2002 Doyle ..... A47B 9/00 108/50.02
6,364,128 B1 * 4/2002 Wohlford ..... A47B 81/06 361/679.01
6,398,149 B1 * 6/2002 Hines ..... G02B 6/4457 242/399
6,416,336 B1 * 7/2002 Schulte ..... H01R 25/006 439/142
6,786,161 B2 9/2004 Fischer
6,912,960 B2 7/2005 Tsai
7,626,120 B1 * 12/2009 Golden ..... H02G 3/0493 174/53
7,634,967 B1 * 12/2009 Albright ..... B01L 9/02 52/220.8
8,893,628 B2 11/2014 McKenzie, III et al.
9,737,142 B2 8/2017 Cho
9,781,996 B1 * 10/2017 Thompson ..... A47B 21/04
9,936,802 B1 * 4/2018 Newhouse ..... H02G 11/00
9,999,295 B1 6/2018 Game et al.
10,004,329 B2 6/2018 Nourse et al.
2002/0043183 A1 * 4/2002 Insalaco ..... A47B 21/06 108/50.02
2002/0046852 A1 * 4/2002 King ..... A47B 21/06 174/500
2002/0145088 A1 * 10/2002 Santoro ..... A47B 9/04 248/188.5
2007/0204537 A1 * 9/2007 Bastian ..... A47B 83/001 52/220.7
2008/0289545 A1 11/2008 Picchio
2009/0078171 A1 * 3/2009 Frost ..... A47B 13/00 108/50.02
2009/0179123 A1 7/2009 Wacker
2009/0293773 A1 * 12/2009 Miller ..... A47B 21/06 108/50.02
2010/0024687 A1 * 2/2010 Preiss ..... A47B 21/06 108/50.02
2014/0208986 A1 7/2014 Desroches et al.
2014/0238277 A1 * 8/2014 Fishman ..... A47B 21/06 108/106
2014/0312754 A1 10/2014 Hecht et al.
2014/0331901 A1 * 11/2014 Seefeldt ..... A47B 13/02 108/50.02
2014/0360413 A1 12/2014 Schenk et al.
2015/0083028 A1 * 3/2015 Bedard ..... A47B 37/00 108/156
2016/0360879 A1 * 12/2016 Kelley ..... A47B 21/06
2016/0360897 A9 12/2016 Sclare et al.
2017/0164731 A1 6/2017 Kemnitzer et al.
2017/0295930 A1 * 10/2017 Bedard ..... A47B 83/04
2017/0324230 A1 * 11/2017 Warrilow ..... A47B 21/06
2018/0064243 A1 3/2018 Keller et al.
2018/0090915 A1 * 3/2018 Byrne ..... A47B 21/06

OTHER PUBLICATIONS

Byrne, "Byrne Interlink ®", webpage: https://www.byrne.com/byrneinterlink, Copyright 2020, (3 Pages).
Byrne, "Twine ®", Brochure from 2019, (2 Pages).
Byrne, "Interlink iQ 2.0" Brochure from 2019, (2 Pages).
Dekko, "DaisyLink System ™", Brochure from 2020 (3 Pages).
Dekko, "Perimeter System", Brochure from 2020 (4 Pages).

* cited by examiner

WORKSTATION ASSEMBLY

FIELD

Various exemplary embodiments relate to a workstation assembly, and in particular, a workstation assembly having cantilevered, vertically adjustable work surfaces.

BACKGROUND

Certain work surfaces are designed to extend outwardly from a base structure. Typically, such work surfaces are supported by one or more legs spaced from the base structure. Such structures are not suitable for height adjustable work surfaces, however, which require coordination between the base and the spaced apart support legs. Moreover, workstation systems that incorporate height adjustable work surfaces are typically one-sided, with only a single work surface extending from the base due to various space and support considerations. As such, these types of systems may not be suited for maximum, efficient use, and may limit collaborative efforts by the user.

It also is desirable to provide power and data access to users of work surfaces. Routing utility lines to the work surface, however, may be problematic with height adjustable work surfaces. In particular, the lines need to be protected, while also allowing for the lines to be played out to different lengths.

SUMMARY

According to certain embodiments, a workstation assembly includes a base having an interior. A height adjustable support column is moveable relative to the base. A work surface is coupled to the support column. A cable track has a first end connected to the base and a second end connected to and moveable with the support column. The cable track includes a flexible cable guide and an outer cover connected to the flexible cable guide.

According to certain embodiments, a workstation assembly includes a base having an interior. A height adjustable support column is moveable relative to the base. A work surface is coupled to the support column. A cable track includes a first end positioned inside of the interior of the base and a second end connected to and moveable with the support column. The cable track includes a flexible cable guide. The first end is spaced from the support column and the cable guide forms a concave section within the interior.

According to certain embodiments, a workstation assembly includes a base having an interior. A height adjustable support column is moveable relative to the base. A work surface is coupled to the support column. A power access point is connected to the work surface and accessible to a user. A motor is connected to the support column to adjust the height relative to the base. A power splitter is connected to the base and configured to receive an AC power input and branch the AC power to a primary path and a secondary path. The power splitter includes a first outlet for connecting to the primary path and a second outlet for connecting to the secondary path. The second outlet is configured to receive a type of plug distinct from the AC power input.

BRIEF DESCRIPTION OF THE DRAWINGS

The aspects and features of various exemplary embodiments will be more apparent from the description of those exemplary embodiments taken with reference to the accompanying drawings, in which.

DETAILED DESCRIPTION OF EXEMPLARY EMBODIMENTS

Figure 1:
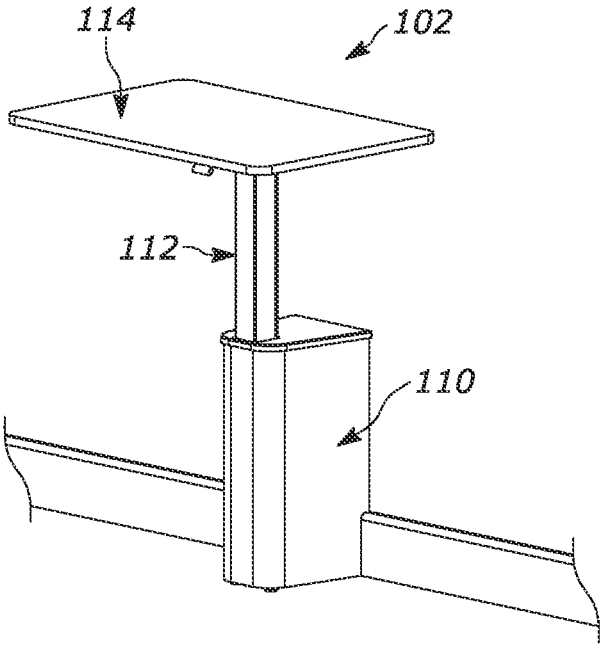
FIG. 1 is a perspective view of a single-unit workstation.
Figure 2:
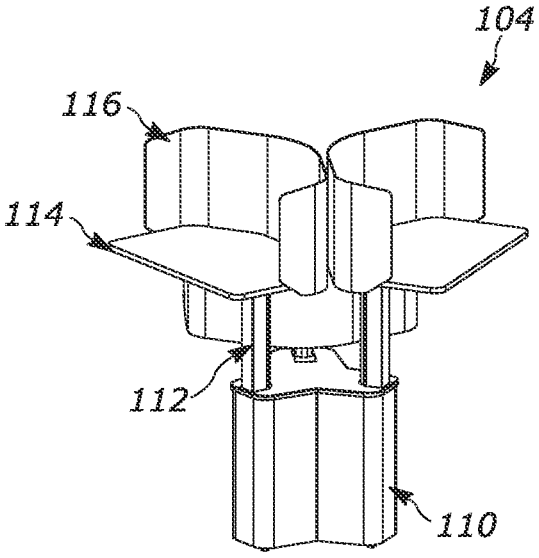
FIG. 2 is a perspective view of a triple-unit workstation.
Figure 3:
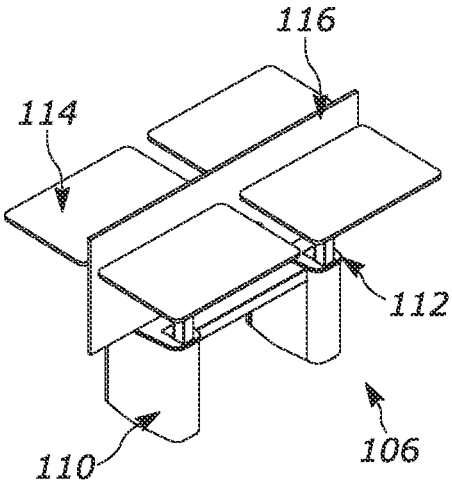
FIG. 3 is a perspective view of a quad-unit workstation.

FIGS. 1-3 show different embodiments of a workstation assembly system. Each assembly provides work space for one or more users. FIG. 1 shows a single-unit workstation 102. FIG. 2 shows a triple-unit workstation 104. FIG. 3 shows a quad-unit workstation 1*o*6. The workstations can be used in office environments or public spaces (e.g., business, libraries, government buildings, etc.) in different combinations and configurations based on the available space. The workstations 102, 104, 106 can be placed along, and connected to, a wall or other vertical support, or can be freestanding units supported only by the floor. For example, the single-unit 102 can be attached to the wall and the triple-unit and quad-unit workstations 104, 106 can be freestanding. Additionally, multiple workstations 102, 104, 106 can be placed adjacent one another and optionally connected to form a chain of units.

Each workstation 102, 104, 106 includes a base 110, one or more support columns 112, and one or more work surfaces 114. The quad-unit workstation 106 can include two bases 110 that are connected. Each work surface 114 is connected to a support column 112 so that the work surface 114 extends from the support column 112 in a cantilevered fashion. The illustrated work surfaces 114 are each supported by a single support column 112. The support column 112 can be height adjustable, and an actuator can be provided to allow a user to raise and lower the support column 112 to adjust the height of the work surface 114. The height adjustment can include a manual raise/lower mechanism or can be electrically powered.

In some aspects, screens 116 can be connected to the work surfaces 114. The screens 116 can extend vertically upward between the different work surfaces 114. The screens 116 can have different shapes, and may include tackable surfaces, writable white board or include various displays, such as a display monitor or projection surface. The screens can be linear along the longitudinal length, or curved, or combinations thereof. The screens 116 can also be configured with a contour to mate with an edge of the work surface 114, including a curved shape.

The workstations 102, 104, 106 can have different exterior finishes. The finishes can include different colors, textures (e.g., smooth, rough, glossy, matte, etc.), and patterns (e.g. wood grain, stone, etc.). These finishes can be achieved by using natural materials or engineered materials such as laminates. For example, the work surfaces 114 can be made of a variety of materials, including without limitation, MDF, chipboard, glass-filled polyurethane, and combinations thereof. The various support components may be made of various metals and plastics, including steel and aluminum.

Figure 4:
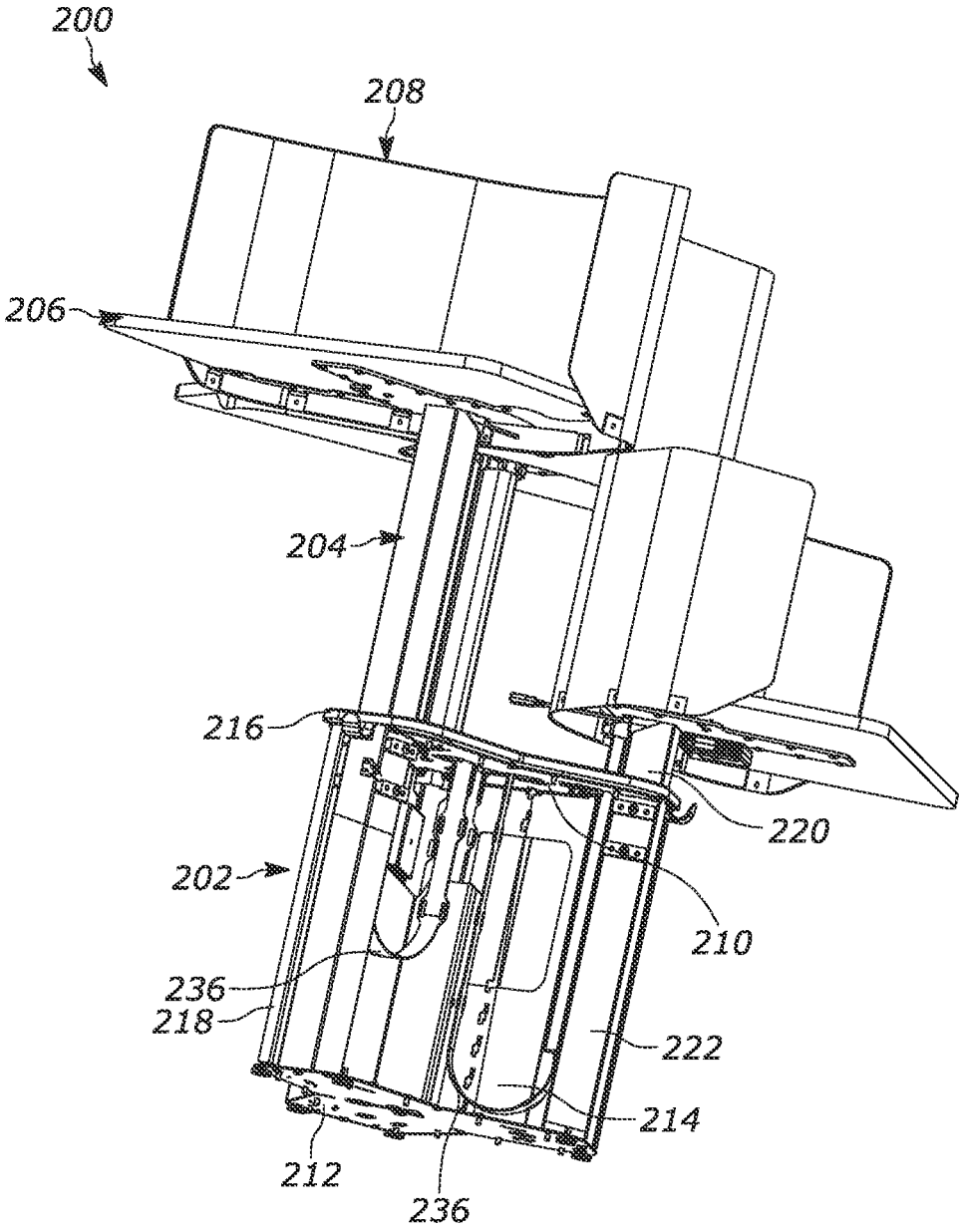
FIG. 4 is a perspective view of a triple-unit workstation showing the interior of the base.

FIG. 4 shows an embodiment of a 3-unit workstation 200 having a base 202, three height adjustable support columns 204, and three work surfaces 206. The support columns 204 extend into and are supported by the base 202. At least a portion of the support columns 204 move to adjust the height of the work surfaces 206 relative to the base 202. Each support column 204 is independently moveable. The work surfaces 206 extend from the respective support columns 204 in a cantilever fashion. Screens 208 are connected to respective work surfaces 206.

The base 202 is configured to be positioned on a floor to support the workstation 200. The base 202 includes an upper plate 210, a lower plate 212, and one or more interior plates 214. The upper plate 210, lower plate 212, and interior plates 214 can provide the support and structure of the base 202, and permit different interior components to be connected thereto. In the illustrated embodiment, three interior panels 214 are used. The upper plate 210, lower plate 212, and interior plates 214 can each be formed from one or more pieces. In certain aspects the plates 210, 212, 214 can be formed from sheet metal, although other materials can be used. The plates 210, 212, 214 can be connected to form a rigid structure using fasteners or a joining process such as welding.

An upper cover 216 and outer walls 218 can be connected to one or more of the plates 210, 212, 214 to form an exterior housing. The upper cover 216 and outer walls 218 can have different finishes to provide a desired aesthetic. The upper cover 216 and outer walls 218 can each be formed from one or more pieces.

Figure 5:
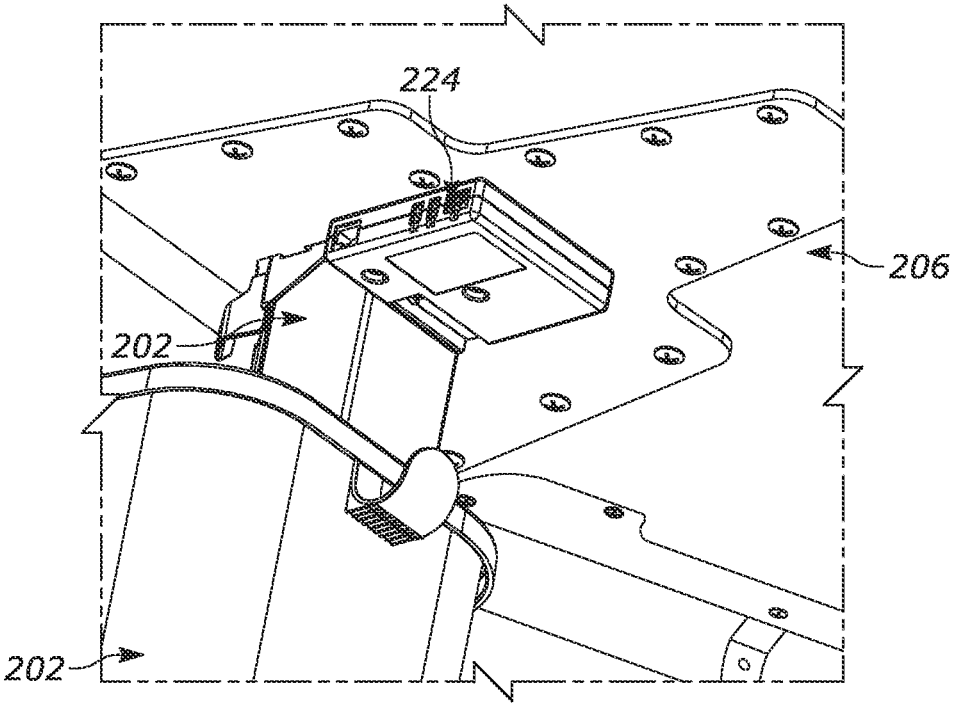
FIG. 5 is a partial, bottom perspective view of the workstation showing a control unit.

The support column 204 can include an upper column 220 and a lower column 222. The lower column 222 is fixed to the base 202, and the upper column 220 moves relative to the base 202 and the lower column 222 to adjust the height of the work surface 206. The upper column 220 can be positioned at least partially inside of the lower column 222 and move in a telescopic manner. The height adjustment can be achieved by an electromechanical screw with a servo motor or as various hydraulic and/or pneumatic devices. A height adjustment switch can be provided so that a user can control the movement of the support column 204. The switch can be positioned on the base 202, the support column 204, or the work surface 206. As best shown in FIG. 5, a control unit 224 can be mounted to the bottom of the work surface 206. The control unit 224 is connected to the height adjustment switch and controls the movement of a motor to raise and lower the upper column 220.

Figure 6:
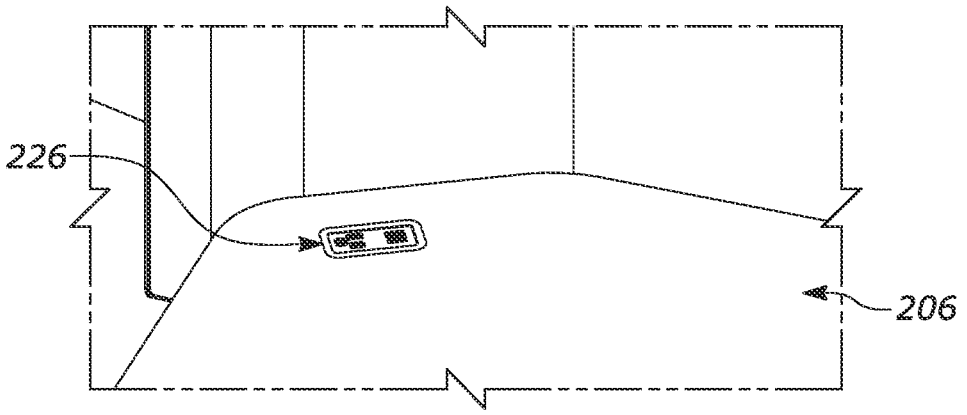
FIG. 6 is a partial, top perspective view of the workstation showing an outlet.

As best shown in FIG. 6, an outlet 226 is accessible to a user on or through the upper surface of the work surface 206. The outlet 226 can extend through the work surface 206 and can be flush or recess mounted with the upper surface. The outlet 226 can include one or more AC-style outlets (e.g., 3-prong outlets) and one or more DC-style outlets (e.g., USB ports). In order to provide the power and data connections to a user, one or more power and data cables need to be routed into base 202. During movement of the support columns 204, it is important to keep these cables from becoming tangled with one another or the moving components.

Figure 7:
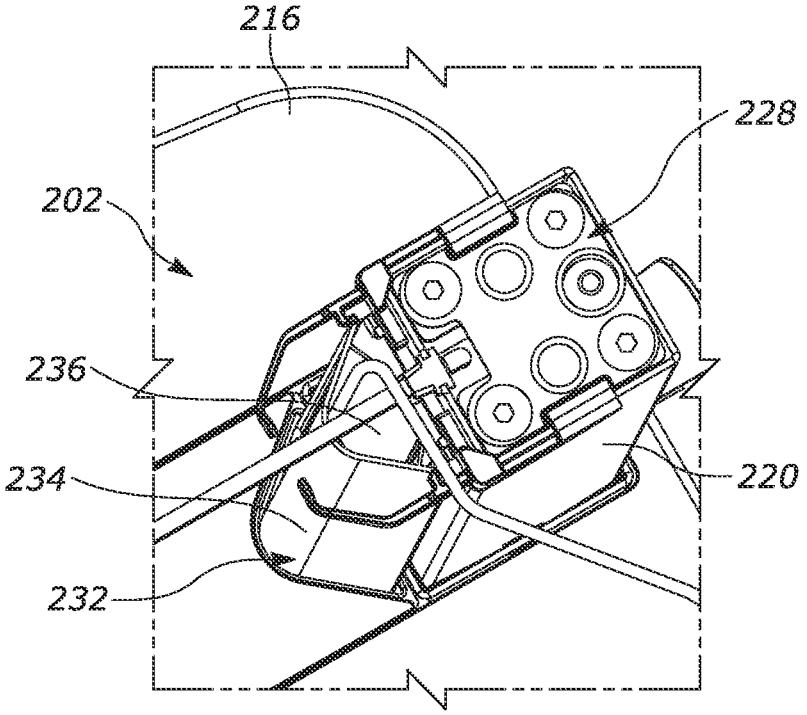
FIG. 7 is a partial, top perspective view of the workstation showing a portion of a cable management system.
Figure 8:
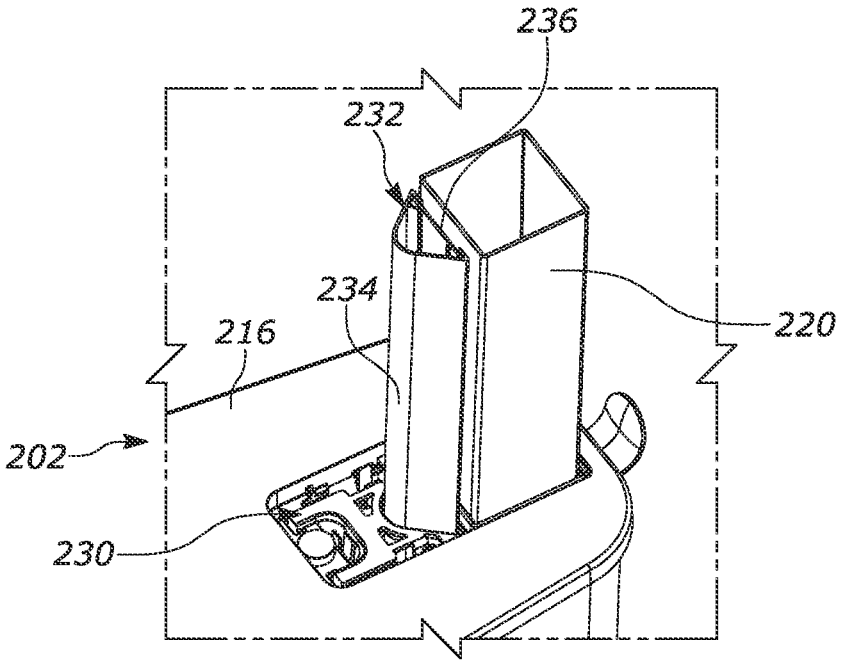
FIG. 8 is a partial, top perspective view of the workstation showing a portion of a cable management system.

FIGS. 7 and 8 show certain aspects of an internal cable management system for the work station 200. The cable management system includes an upper bracket 228 connected to the top of the upper column 220, a lower bracket 230 connected to the base 202, and a cable track 232. The cable track 232 includes an outer cover 234 and a cable guide 236. One or more cables can be guided into the base 202 through the support column 204 and/or through the cable track 232.

Figure 9:
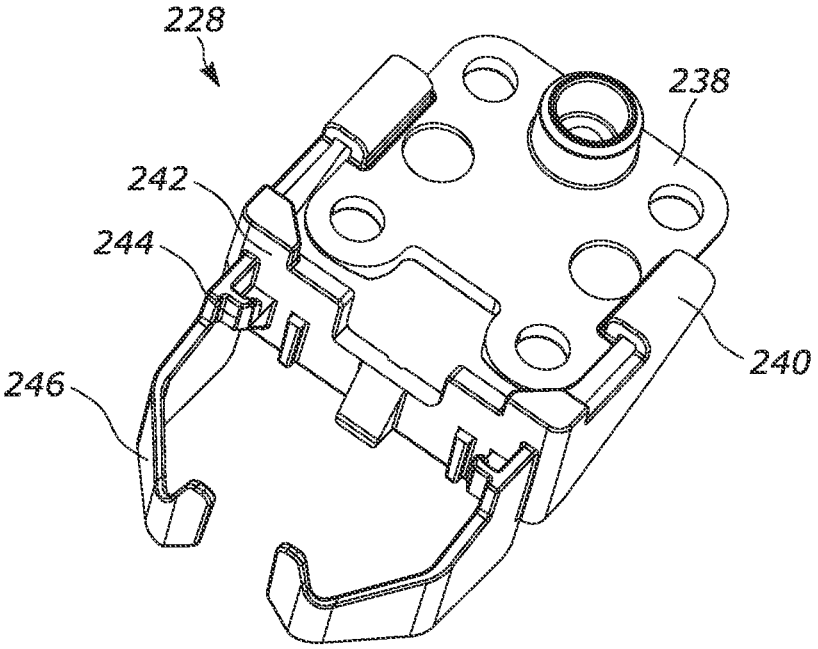
FIG. 9 is a top perspective view the upper bracket shown in FIG. 7.

As best shown in FIGS. 7 and 9, the upper bracket 228 includes a connector plate 238 having various openings and bosses that are used to receive fasteners to connect the upper bracket 228 to the upper column 220 and the work surface 206. A u-shaped projection 240 extends from each side of the connector plate 238 and is configured to rest on an upper edge of the upper column 220. A front wall 242 extends in front of the connector plate 238. Tabs 244 extend from the front wall 242. The tabs 244 can connect the cable guide 236 to the upper bracket 228. A pair of arms 246 extend from the outer edges of the front wall 242. The arms 246 are curved or angled toward each other and include a hooked portion at each end.

Figure 10:
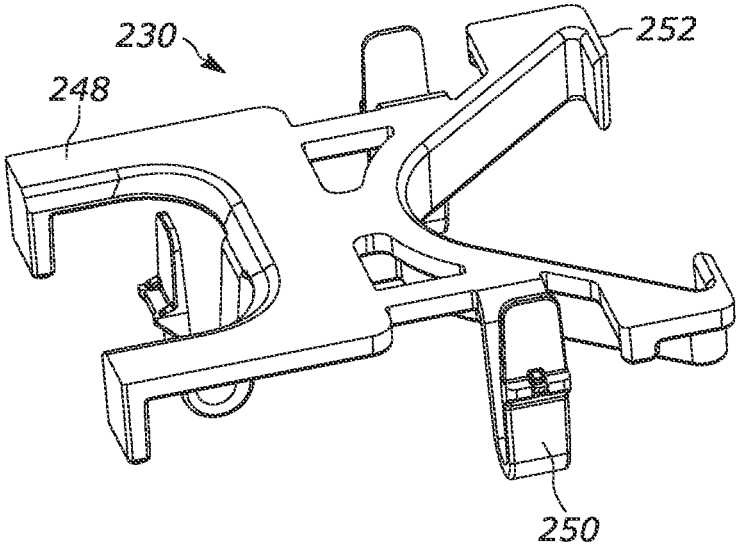
FIG. 10 is a top perspective view of the lower bracket shown in FIG. 8.

As best shown in FIGS. 8 and 10, the lower bracket 230 includes a front fork 248 and a pair of flexible side tabs 250 that are used to connect the lower bracket 230 to the upper plate 210 or outer cover 216 of the base 202. A yoke 252 is configured to receive a portion of cable track 232 and provide a smooth sliding surface for the movement of the cable track 232.

As best shown in FIGS. 7 and 8 the cable track 232 is connected to the upper bracket 228 and is guided by the lower bracket 230 as the upper column 220 moves relative to the lower column 222 and the base 202. The outer cover 234 has a pyramidal configuration with a rounded top. Resilient tines 254 extend toward the cable guide 236 and are used to connect the outer cover 234 to the cable guide 236. The outer cover 234 can have a finish that matches or is complimentary to the finish of one or more of the base 202 and the work surface 206 to provide a consistent aesthetic appearance.

Figure 11:
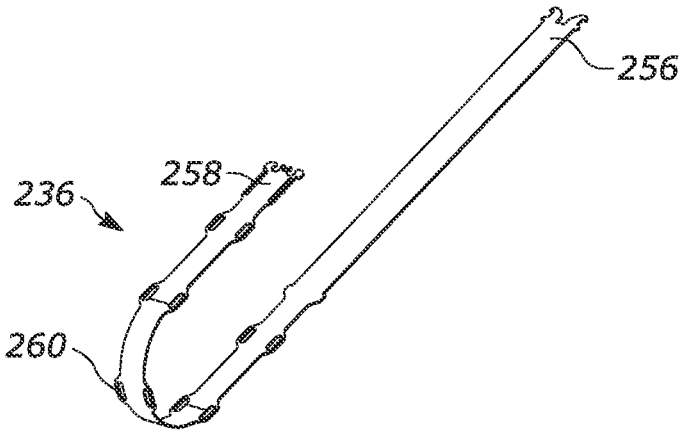
FIG. 11 is a perspective view of a cable guide.
Figure 12:
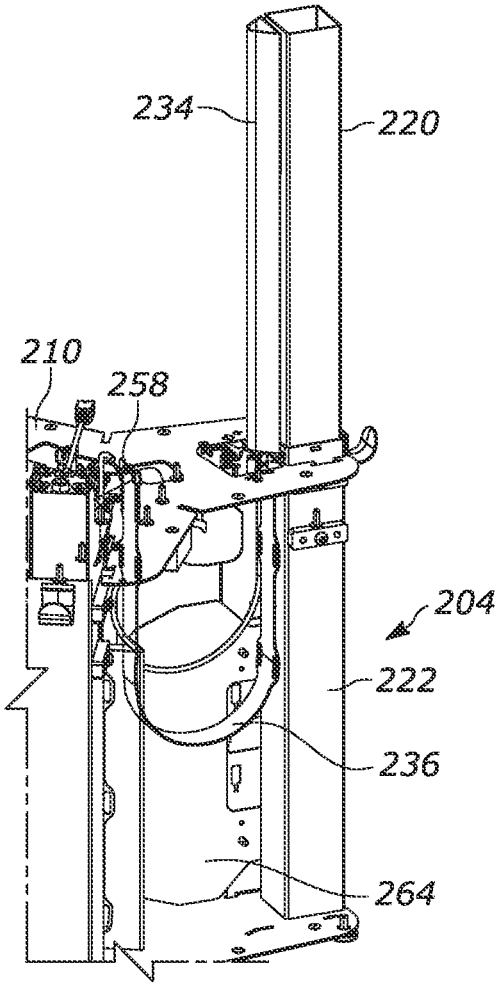
FIG. 12 is a perspective view of the support column and interior of the base.

As best shown in FIGS. 4, 7, and 11, the cable guide 236 includes a first end 256 that is connected to the upper bracket 228 and a second end 258 that is connected to the upper plate 210 of the base 202. The first end 256 and the second end 258 each include one or more mounting features that fasten the cable guide 236. For example the cable guide 236 can be clipped or snap fit to the upper bracket 228 and to the top plate 210. One or more sets of outer openings 260 are formed in the cable guide 236. These openings 260 can receive straps (e.g., cable ties, Velcro, etc.) that fasten conductors to the cable guide 236. The cable guide 236 can include a flexible material so that the cable guide 236 can bend as it moves with the upper column as best shown in FIGS. 4 and 12. As shown in FIG. 12, the second end 258 of the cable guide is spaced from the support column 204 so that a loop is formed to support the cables and keep them from tangling.

Figure 13:
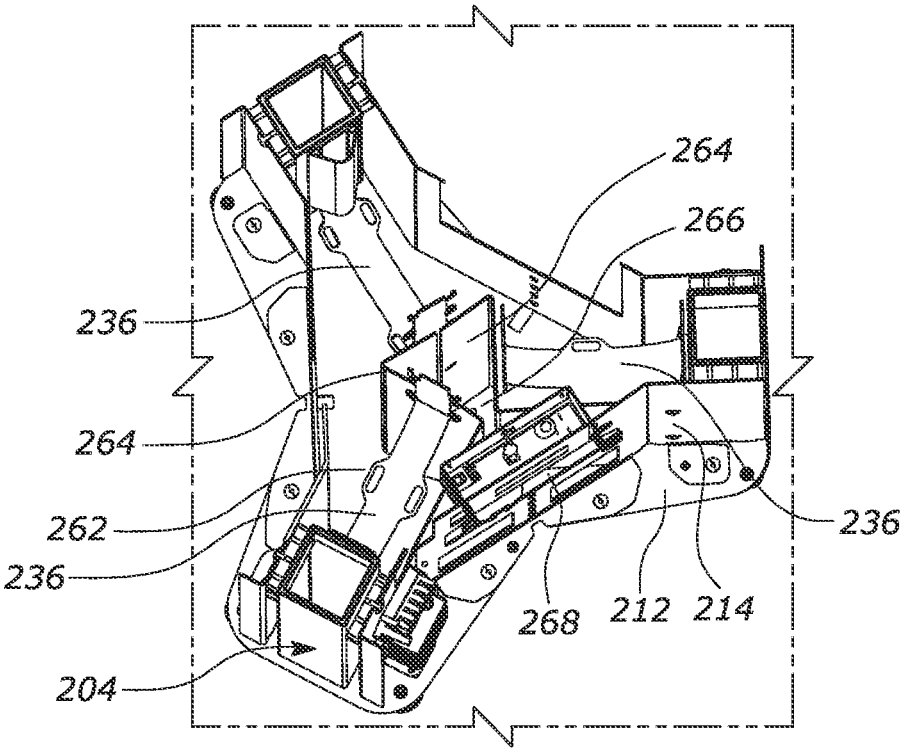
FIG. 13 is a top perspective view of the interior of the base.
Figure 14:
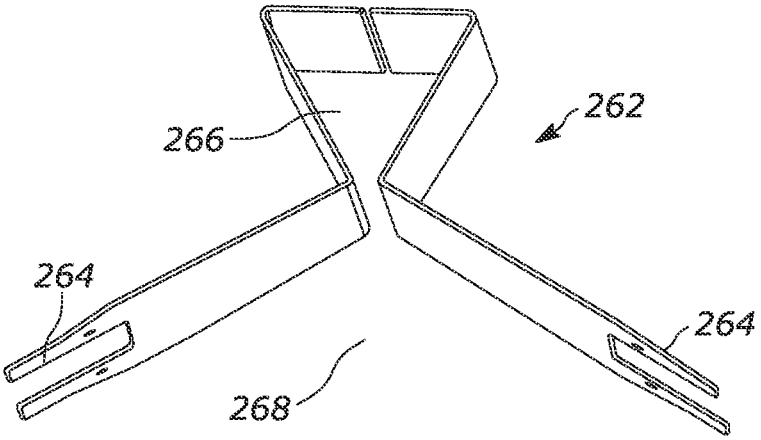
FIG. 14 is a perspective view of the baffle assembly.

The internal cable management can also include a baffle assembly 262 that has one or more baffle plates 264 positioned in the base 202. As shown in FIGS. 13 and 14, two baffles 264 are connected to one of the interior plates 214 and have a substantially Z-shaped configuration. The baffles 264 extend toward one another and into the center of the base 202. The configuration and positioning of the baffles 264 forms a first pocket 266 near the center of the base and a second pocket 268 adjacent one of the interior plates. The second pocket 268 can be positioned near one or more power supply components positioned in the base 202 and protect cables connected thereto. Extra non-moving cables can also be stored or routed through the first pocket 266. The baffles 264 also help prevent the cable guides 236 of each column from interfering with one another as they move.

Figure 15:
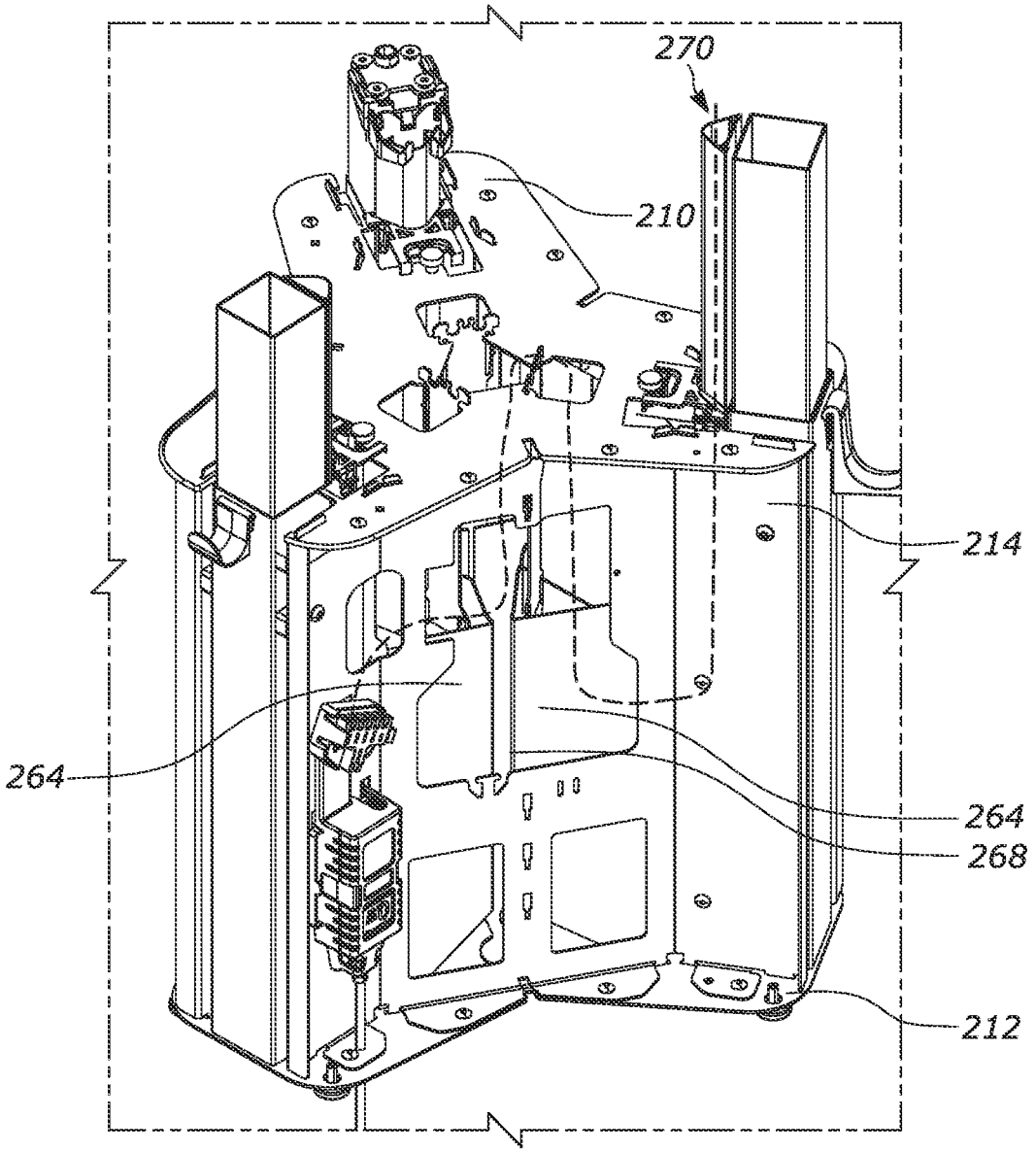
FIG. 15 is a partial top perspective view of the interior of the base showing exemplary cable connections.

For example, as shown in FIG. 15, the cables 270 connected to the user power supply (AC) and to the motors for the support column (DC) are routed down the center of the base 202 where they exit the cable tracks. The cables exit the first pocket 266 into the second pocket 268 through a space between the baffles 264 and extend to either an AC splitter or a DC splitter. Although two baffle plates 264 are shown, the baffle assembly 262 can be formed from one baffle plate 264 or more than two baffle plates 264. The size, shape, and configuration of the baffle assembly 262 can be adjusted based on the size, shape, and configuration of the base as well as the cable management requirements.

Although a triple-unit workstation 200 is shown and described in detail, these features can be applied to the single unit workstation 100 and the quad-unit workstation 104.

Figure 16:
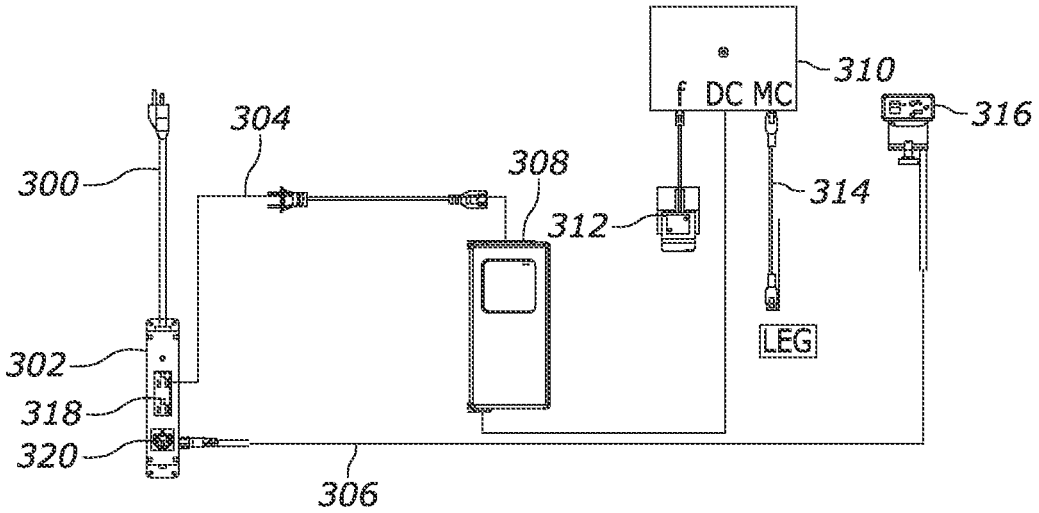
FIG. 16 is a schematic for a single-unit workstation.
Figure 17:
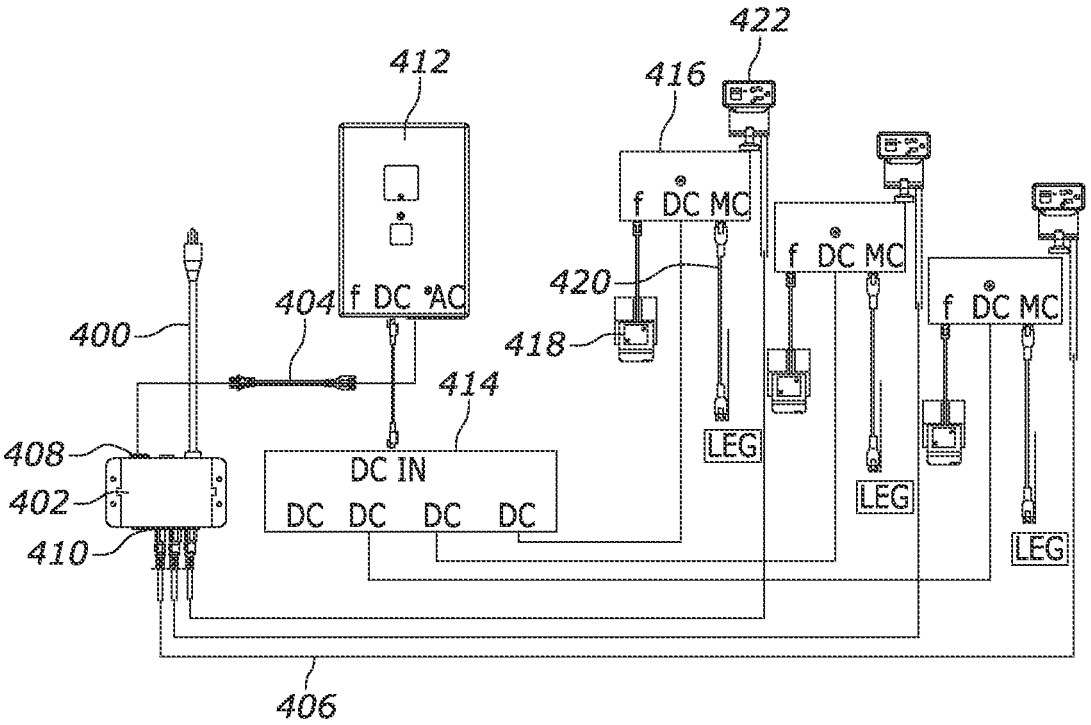
FIG. 17 is a schematic for a triple-unit workstation.
Figure 18:
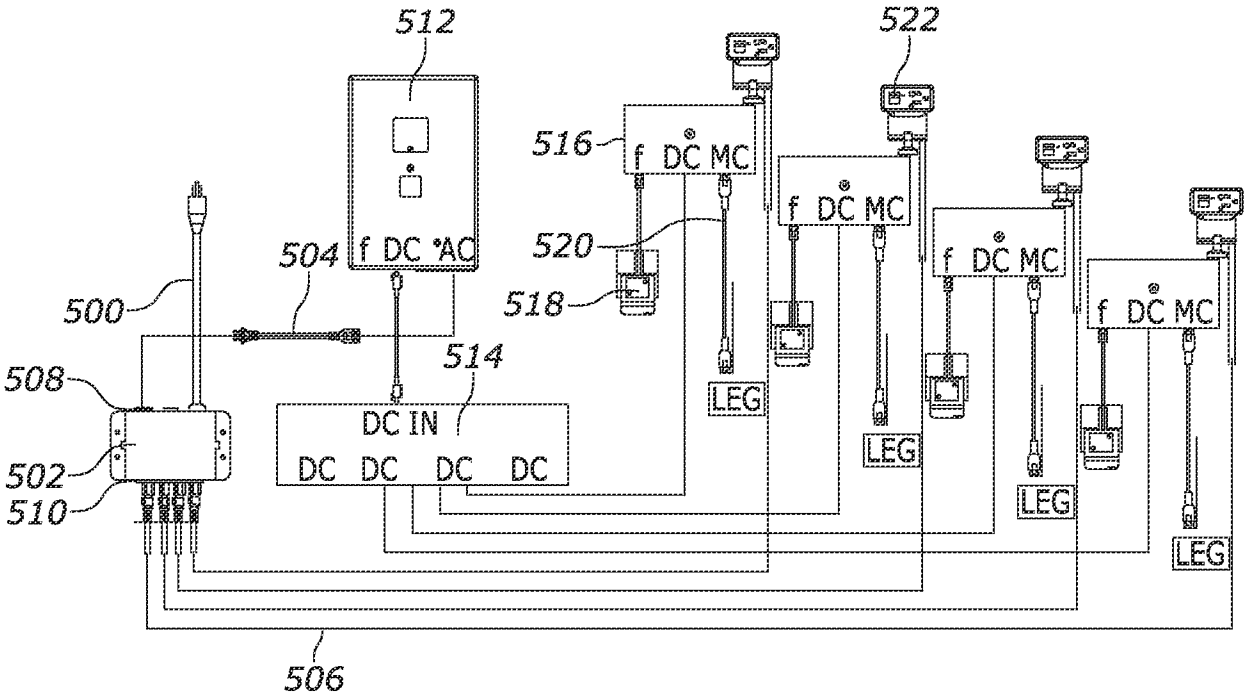
FIG. 18 is a schematic for a quad-unit workstation.

FIGS. 16-18 show exemplary schematics of the power supply components that can be incorporated into the different workstations 100, 102, 104. FIG. 16 shows am exemplary schematic for a single-unit workstation. An AC power input 300 is connected to an AC splitter 302. The AC splitter 302 branches power along two or more outputs. FIG. 16 shows a primary path 304 and a secondary path 306. The primary path 304 extends to an AC/DC converter 308. The AC/DC converter 308 converts the AC input to a DC output that is sent to a motor controller 310. The motor controller 310 includes a DC power input and a control input. The control input receives a signal from a switch 312 activated by a user. The signal indicates a raise or lower command for the support column. Based on the command, a voltage signal is sent to the motor through a motor cable 314 to raise or lower the support column. The secondary path 306 sends power to a user access point 316 (e.g., the outlet shown in FIG. 6).

In certain embodiments, the AC splitter can contain two distinct types of outlets. For example, the first type of outlet 318 can be a 1-15R (two prong) or 5-15R (three prong) type outlet and the second type of outlet 320 can be a C13 style outlet. Other types of outlets, including bayonet style, pin outlets, or 3 phase outlets can also be used. In other embodiments, the second type of outlet 320 has a different style connection than the power input 300. For example, as shown in FIG. 16, the power input 300 includes a 5-15P plug and the outlets 320 for the secondary path 306 utilize a C13 outlet and a C14 plug.

FIG. 17 shows an exemplary schematic for a triple-unit workstation. An AC power input 400 is connected to an AC splitter 402. The AC splitter 402 branches power along a primary path 404 and three secondary paths 406. The output for the primary path 404 includes a first type of outlet 408 and the output for the secondary paths 406 includes a second type of outlet 410 distinct from the first type of outlet 408. Additionally, the power input 400 includes a first style of plug that is configured to engage a first type of outlet (e.g., a 3-prong wall outlet). The secondary paths 406 each include a second style of plug that different from the power input 400. For example, the first style of plug may be a NEMA type connector (e.g., NEMA 5-15-P), while the second style of plug may be an IEC type connector (e.g., IEC 320 C13/C14). In some embodiments, the primary path 404 and each secondary path 406 may include the same style of plugs. In other embodiments, the primary path 404 and the secondary paths 406 may include different styles of plugs. The AC splitter 402 may also include one or more additional outlets, such as NEMA type outlets.

The primary path 404 extends to an AC/DC converter 412. The AC/DC converter 412 converts the AC input to a DC output that is sent to a DC splitter 414. The DC splitter 414 branches the DC power along three output paths, with each path connected to a motor controller 416. The motor controller 416 includes a DC power input and a control input. The control input receives a signal from a switch 418 activated by a user. The signal indicates a raise or lower command for the associated support column. Based on the command, a voltage signal is sent to the motor through a motor cable 420 to raise or lower the support column. Each of the motor controllers 416 and associated motors are operable independently, but can also be used at the same time (e.g., one work surface can be raised at the same time another work surface is being lowered). The motor controllers 416 and the motors all receive power from a single, shared power source via the AC splitter 402.

The three secondary paths 406 send power to a respective user access point 422 (e.g., the outlet shown in FIG. 6). As noted above, each access point 422 may include one or more AC-style outlets and one or more DC-style outlets. By using the different, second style of plugs on the secondary paths 406, the multiple outlets on each access point 422 can be daisy-chained from the AC splitter 402 (which also includes multiple outlets). As such, the workstation can be connected to a wall outlet to power the motor controllers 416 and the user access points 422 using a single plug.

FIG. 18 an exemplary schematic for a quad-unit workstation. An AC power input 500 is connected to an AC splitter 502. The AC splitter 502 branches power along a primary path 504 and four secondary paths 506. Similar to the three-unit workstation (FIG. 17), the power input 500 includes a first style of plug, while the secondary paths 5o6 include a second style of plug. The primary path 504 extends to an AC/DC converter 512. The AC/DC converter 512 converts the AC input to a DC output that is sent to a DC splitter 514. The DC splitter 514 branches the DC power along four output paths, with each path connected to a motor controller 516. The motor controller 516 includes a DC power input and a control input. The control input receives a signal from a switch 518 activated by a user. The signal indicates a raise or lower command for the support column. Based on the command, a voltage signal is sent to the motor through a motor cable 520 to raise or lower the support column. The four secondary paths 5o6 send power to a respective user access point 522 (e.g., the outlet shown in FIG. 6).

The foregoing detailed description of the certain exemplary embodiments has been provided for the purpose of explaining the general principles and practical application, thereby enabling others skilled in the art to understand the disclosure for various embodiments and with various modifications as are suited to the particular use contemplated. This description is not necessarily intended to be exhaustive or to limit the disclosure to the exemplary embodiments disclosed. Any of the embodiments and/or elements disclosed herein may be combined with one another to form various additional embodiments not specifically disclosed. Accordingly, additional embodiments are possible and are intended to be encompassed within this specification and the scope of the appended claims. The specification describes specific examples to accomplish a more general goal that may be accomplished in another way.

As used in this application, the terms "front," "rear," "upper," "lower," "upwardly," "downwardly," and other orientational descriptors are intended to facilitate the description of the exemplary embodiments of the present disclosure, and are not intended to limit the structure of the exemplary embodiments of the present disclosure to any particular position or orientation. Terms of degree, such as "substantially" or "approximately" are understood by those of ordinary skill to refer to reasonable ranges outside of the given value, for example, general tolerances associated with manufacturing, assembly, and use of the described embodiments.

What is claimed:

1. A workstation assembly comprising:

a base having an interior;

a height adjustable support column moveable relative to the base;

a work surface coupled to the support column;

a cable track having a first end connected to the base and a second end connected to and moveable with the support column, the cable track including a flexible cable guide and an outer cover connected to the flexible cable guide; and a lower bracket connected to the base and configured to receive and guide the movement of the cable track.

2. The work station assembly of claim 1, wherein the cable track is connected to the support column by an upper bracket.

3. The work station assembly of claim 2, wherein the upper bracket engages the support column.

4. The work station assembly of claim 1 wherein the lower bracket includes a yoke that receives the cable track.

5. The workstation assembly of claim 4, wherein the lower bracket includes a set of flexible tabs that connect the lower bracket to the.

6. The work station assembly of claim 1, further comprising a baffle assembly positioned in the interior, the baffle assembly forming a first pocket for receiving a cable.

7. The work station assembly of claim 1, wherein the cable guide includes a plurality of openings configured to receive a strap to secure a cable to the cable guide.

8. The work station assembly of claim 1, further comprising a power splitter configured to receive an AC power input and branch the AC power to a primary path and a secondary path, the power splitter including a first outlet for connecting to the primary path and a second outlet for connecting to the secondary path, wherein the second outlet is configured to receive a type of plug distinct from the AC power input.

9. A workstation assembly comprising:

a base having an interior;

a height adjustable support column moveable relative to the base;

a work surface coupled to the support column; and a cable track having a first end positioned inside of the interior of the base and a second end connected to and moveable with the support column, the cable track including a flexible cable guide and wherein the first end is spaced from the support column and the cable guide forms a concave section within the interior.

10. The workstation assembly of claim 9, further comprising an outer cover removably connected to the flexible cable guide.

11. The workstation assembly of claim 10, wherein the outer cover extends above the base.

12. The work station assembly of claim 9, further comprising a baffle assembly positioned in the interior, the baffle assembly forming a first pocket for receiving a cable.

13. The work station assembly of claim 9, wherein the cable track is connected to the support column by an upper bracket and a lower bracket is connected to the base and configured to receive and guide the movement of the cable track.

14. The workstation assembly of claim 9, further comprising a power access point connected to the work surface and accessible to a user and a power splitter configured to receive an AC power input and branch the AC power to a primary path and a secondary path.

15. A workstation assembly comprising:

a base having an interior;

a height adjustable support column moveable relative to the base;

a work surface coupled to the support column;

a power access point connected to the work surface and accessible to a user;

a motor connected to the support column to adjust the height relative to the base;

a power splitter connected to the base and configured to receive an AC power input and branch the AC power to a primary path and a secondary path, the power splitter including a first outlet for connecting to the primary path and a second outlet for connecting to the secondary path, wherein the second outlet is configured to receive a type of plug distinct from the AC power input.

16. The workstation of claim 15, wherein the AC power input includes a 5-15 P plug and the second outlet is configured to receive a C14 plug.

17. The workstation of claim 15, wherein the primary path provides DC power to the motor.

18. The workstation of claim 17, wherein a converter and a splitter are positioned between the first outlet and the motor.

19. The workstation of claim 15, wherein the secondary path provides power to the power access point.

20. The workstation of claim 15, further comprising a cable track having a first end fixed to the base and a second end connected to and moveable with the support column, the cable track configured to receive and guide a cable connected to the power access point.

* * * * *